US005305415A

United States Patent [19]

Stevens

[11] Patent Number: 5,305,415

[45] Date of Patent: Apr. 19, 1994

[54] ELECTRIC STEAM GENERATOR HAVING MOLDED PLASTIC LID AND BASE SECURED TOGETHER BY A SNAP-FIT CONNECTION ARRANGEMENT

[75] Inventor: Paul Stevens, Croydon, Great Britain

[73] Assignee: Earlex Limited, Godalming, England

[21] Appl. No.: 768,564

[22] PCT Filed: Mar. 21, 1990

[86] PCT No.: PCT/GB90/00431

§ 371 Date: Oct. 29, 1991

§ 102(e) Date: Oct. 29, 1991

[87] PCT Pub. No.: WO90/13771

PCT Pub. Date: Nov. 15, 1990

[30] Foreign Application Priority Data

Apr. 29, 1989 [GB] United Kingdom ..... 8909510

[51] Int. Cl.[5] ..... F22B 1/28; F22B 37/04; H05B 3/82

[52] U.S. Cl. ..... 392/403; 219/437; 219/440; 220/306; 220/308; 220/DIG. 14; 220/DIG. 20; 392/325; 392/401; 392/447

[58] Field of Search ..... 392/394, 400, 401, 402, 392/403–406, 444–449, 485–492, 325, 326; 219/436, 438, 440, 437, 430; 220/306, 308, 356, 357, DIG. 14, DIG. 20

[56] References Cited

U.S. PATENT DOCUMENTS

| | | | |
|---|---|---|---|
| 2,824,207 | 2/1958 | Beiermann | 392/403 |
| 3,424,547 | 1/1969 | Winniett | 392/403 |
| 3,499,574 | 3/1970 | Yates | 220/308 |
| 3,618,802 | 11/1971 | Yates | 220/308 |
| 3,769,902 | 11/1973 | Hurwitz | 219/440 X |
| 4,092,519 | 5/1978 | Eaton-Williams | 392/325 |
| 4,261,353 | 4/1981 | Bartels | 392/403 |
| 4,366,367 | 12/1982 | Mazzacco | 392/403 |
| 4,391,459 | 7/1983 | Wicke et al. | 392/401 X |
| 4,457,447 | 7/1984 | Kirkis | 220/308 |
| 4,520,973 | 6/1985 | Nielsen | 220/306 |
| 4,585,138 | 4/1986 | Jonkers | 220/308 |
| 4,819,824 | 4/1989 | Longbottom | 220/306 |

FOREIGN PATENT DOCUMENTS

| | | | |
|---|---|---|---|
| 2193563 | 2/1988 | United Kingdom | 392/487 |

*Primary Examiner*—Anthony Bartis

[57] ABSTRACT

A portable electric wallpaper steamer has a generator (G) including a base (1) and lid (2), both injection molded of plastic material. An elastomeric sealing ring (29) is seated in a recess in a circumferential interengagement zone between the lid and base and is held compressed by the interengagement of engagement members (24) on the lid with cooperating engagement members (39) on the base. The lid-engagement members (24) and base-engagement members (39) comprise integrally molded parts of the lid and base and one or both are resiliently deformable so that they can be brought into snap-fit engagement with each other by downward movement of the lid relative to the base to form a steam pressure tight seal. An electric heating element (6) is mounted in the base for heating water therein to generate steam. The lid includes a handle (9), filling port (10), safety valve (13) and a steam outlet port (21) connected to a wall paper steaming plate (W) by a pipe.

23 Claims, 4 Drawing Sheets

ELECTRIC STEAM GENERATOR HAVING MOLDED PLASTIC LID AND BASE SECURED TOGETHER BY A SNAP-FIT CONNECTION ARRANGEMENT

FIELD OF THE INVENTION

The invention relates to a steam generator particularly, though not exclusively, for use in a wallpaper steamer.

BACKGROUND OF THE INVENTION

Wallpaper steamers are known for moistening old wallpaper so that it can be readily removed from walls prior to redecorating.

In a steam generator for a prior wallpaper steamer, we attach the lid to the base of the steamer by means of C-section metal strips slid onto abutting flanges of the lid and base—which are of moulded plastics material. This means of attachment of the lid is restrictive on the design of the generator—i.e. requiring straight runs of the strip along the joints, making the generator rectangular. The strips add expense and assembly cost.

The present steam generator has been developed as a simpler, cheaper product.

Plastics material containers are known in which the lid resiliently engages the base and seals sufficiently tightly for storage of food for instance at ambient pressure. The lid has a circumferential groove into which an upstanding rim of the base extends. This arrangement is inadequately pressure tight for a steam generator. In particular a separate sealing element appears to be necessary.

THE INVENTION

A steam generator of the invention comprises:

a moulded plastics material base including a sidewall;

a moulded plastics material lid;

the lid and the base defining between them a circumferential inter-engagement zone;

the lid having at the inter-engagement zone at least one engagement member with an engagement face directed generally away from the base (when assembled thereto);

the base having at the inter-engagement zone at least one engagement member with an engagement face directed generally away from the lid (when assembled thereto);

an electrical heating element mounted in the base; and an elastomeric sealing ring arranged on assembly, around the circumferential inter-engagement zone, between the base and the lid;

the lid- and base-engagement members engaging via their engagement faces with resilient deformation of either or both of the lid- and base-engagement members on assembly of the lid to the base so as to compress the sealing ring for sealing contact with both the base and the lid.

Preferably, the engagement face(s) of at least one of the lid- and base-engagement members is a lip adapted and arranged to engage the corresponding engagement face of the other engagement member(s). In the preferred embodiment, the engagement faces of both of the lid- and base-engagement members are respective lips, each adapted and arranged to engage the corresponding lip on the corresponding other engagement member. Conveniently, one of the lid- and base-engagement members extends generally towards the base or lid respectively and the other of the engagement members extends adjacent to the one engagement member (when assembled thereto).

Preferably, one or other of the base and lid, conveniently the base, includes a recessed seat for the elastomeric sealing ring and the other of the base and the lid has a plain sealing surface opposite the recessed seat. The recessed seat and the plain sealing surface are preferably arranged inwardly of the lid- and base-engagement members.

It is envisaged that the lid- and the base-engagement member(s) may be continuous circumferentially around the lid and the base. However if the or each lid-engagement member is arranged outwardly of the respective base-engagement member, its lip is difficult to remove from the moulding tool unless an expensive/complex tool is used. If a continuous base-engagement member engaging outside the lid-engagement member is used, even more severe difficulties are encountered. Accordingly it is preferred to employ a plurality of separate individual engagement members distributed circumferentially around the lid and the base. Moulding difficulties may still be encountered if the lid engagement members are outermost; accordingly they are preferably provided inwardly of the base engagement members and respective apertures are provided between the sidewall of the base and the individual base-engagement members for receiving the corresponding lid-engagement members. This arrangement permits a simple mould to be used.

The radially inner edge of each aperture may be provided with a stiffening flange, conveniently connected to the sidewall by one or more struts, and the corresponding lid-engagement member may be provided with an anti-disengagement surface, conveniently on a rib, abutting the stiffening flange.

The individual base-engagement members are preferably interconnected by circumferential continuations and connected to the base by radial webs.

Advantageously, location flanges are provided separate from, and radially outward from, but in circumferential continuation of the lid-engagement member for location outside the mentioned circumferential continuations. Conveniently, each of the circumferential continuations is stepped to provide a lower portion having a radially outer surface flush with a radially outer surface of the corresponding said location flange.

Preferably, a further, continuous inner flange is provided on the underside of the lid, inwardly of the engagement members to locate the lid on the base by engagement therewith radially inwardly of the seat for the sealing ring. The lid may also include at least one upstanding flange for reinforcement of the lid to exert compression on the sealing ring.

The lid is preferably substantially flat, although slightly upwardly domed. Conveniently it incorporates a carrying handle, a safety valve, a filler cap inlet and steam outlet.

To help understanding of the invention, a specific embodiment thereof will now be described with reference to the accompanying drawings, in which:

THE DRAWINGS

Figure 1:
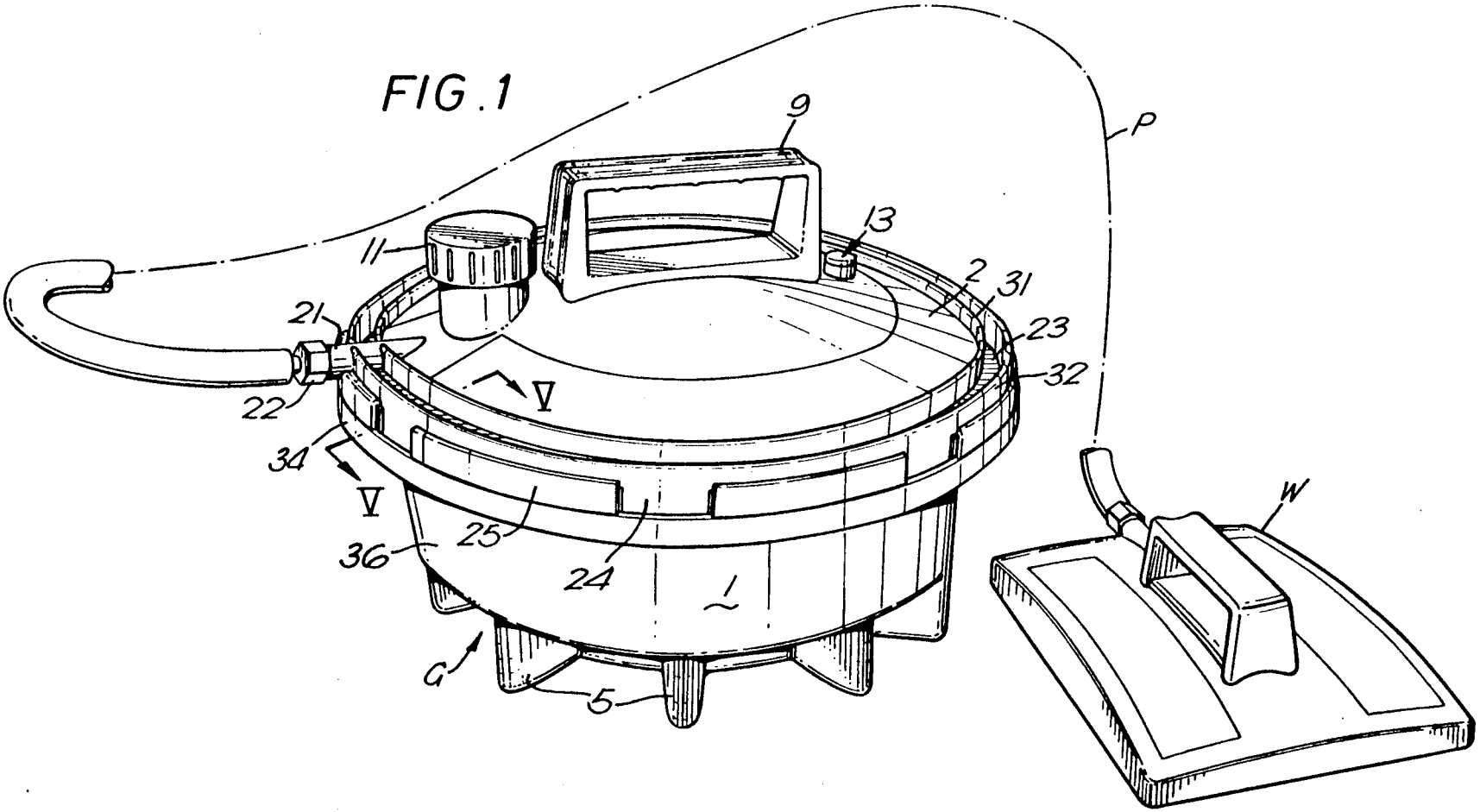
FIG. 1 shows in a perspective view a wallpaper steamer including a steam generator of the invention and a wall plate.

Referring to the drawings, the wallpaper steamer shown in FIG. 1 comprises a steam generator G and a hollow-underside wall plate W interconnected by a pipe P. In use, water is boiled in the generator G to form steam which is led by the pipe P to the wall plate W for application to wallpaper to be steamed and stripped.

Figure 2:
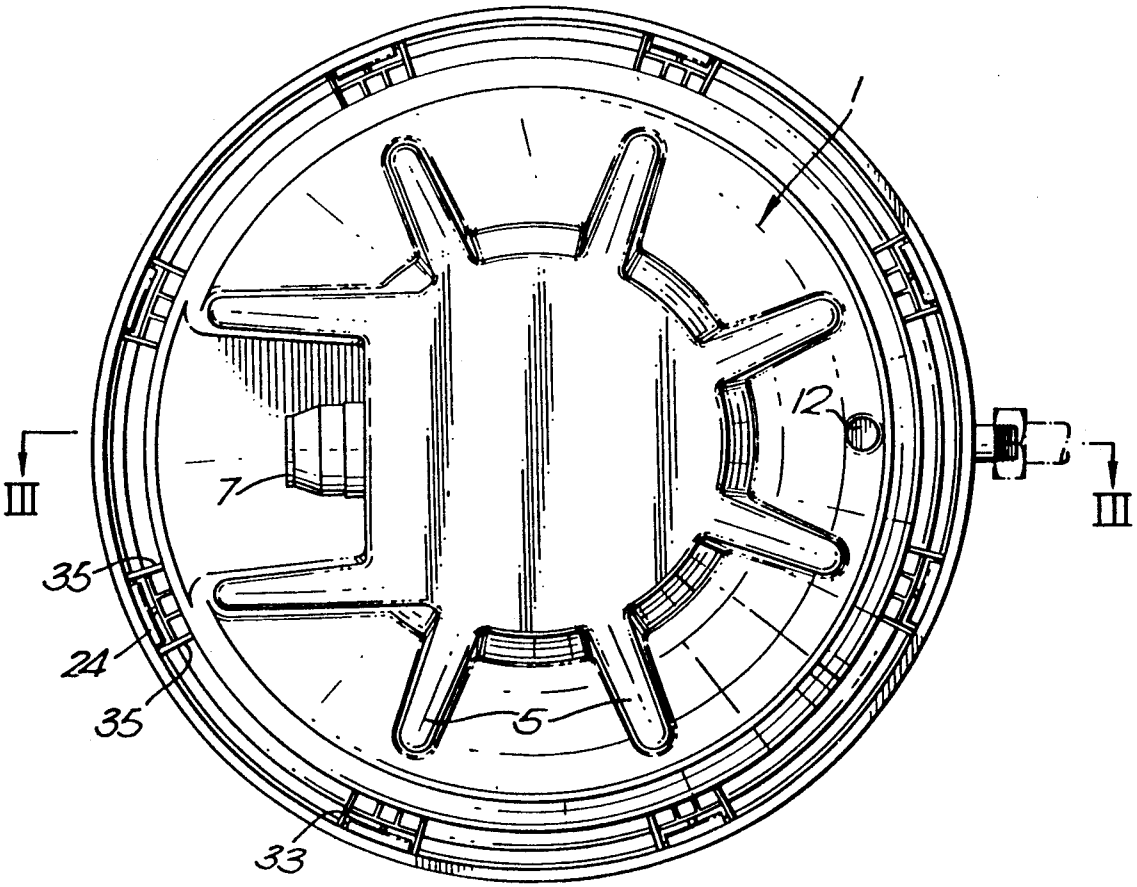
FIG. 2 is an underneath plan view of the steam generator of FIG. 1.
Figure 3:
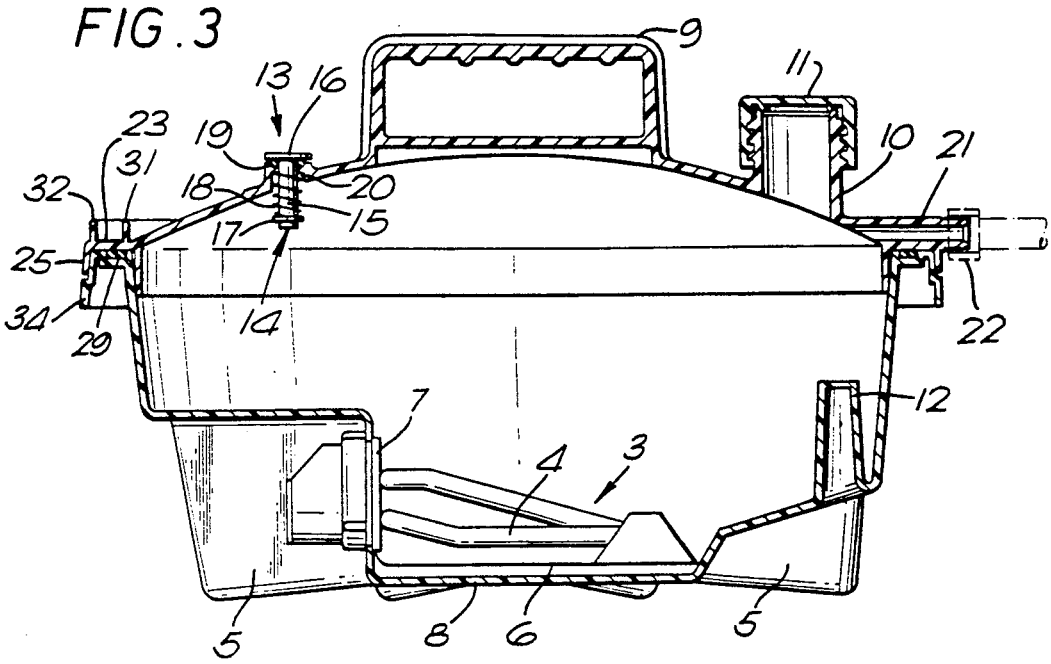
FIG. 3 is a cross-sectional view on the line III—III in FIG. 2.
Figure 4:
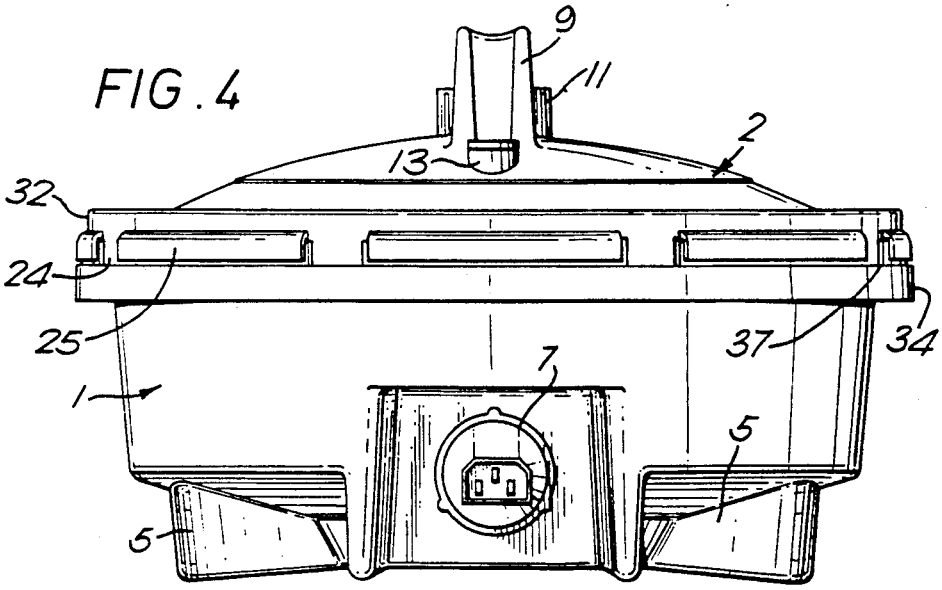
FIG. 4 is a rear view of the steam generator.

The steam generator G comprises a base 1 and a lid 2, both being injection mouldings of plastics material, preferably heat stabilized polypropylene. As shown in FIGS. 3 and 4, the base has a central depression 3 in which an electrical heating element 4 is disposed and from which radiate a series of fins 5 (FIG. 2) for stability of the steam generator. The heating element 4 is of the type conventionally used in kettles. A stainless steel plate 6 is secured by the fitting 7 of heating element 4 to extend between the heating element 4 and the bottom wall 8 of the central depression to protect the latter in the event of the steam generator boiling dry.

The lid 2 is domed slightly upwardly and has an integrally moulded central carrying handle 9, a filling inlet 10 with a pressure tight moulded plastics cap 11. Upstanding from the bottom of the base 1 is a level indicating finger 12 which is visible through the inlet 10 with the cap 11 removed. On the opposite side of the handle 9 from the inlet 10 is a safety valve 13 comprised of a moulded plastics plunger 14 with a stem 15 and a head 16. The stem 15 carries a circlip 17 and a spring 18 which biases the plunger 14 downwards for captivation of an O-ring 19 between the head 16 and the lid 2 around an aperture 20. The spring 18 is light, allowing the safety valve 13 to open at 4 psig (approximately 0.25 bar). The lid 2 also incorporates a moulded, threaded outlet spout 21 to which the pipe P is connected by a union 22.

Figure 5:
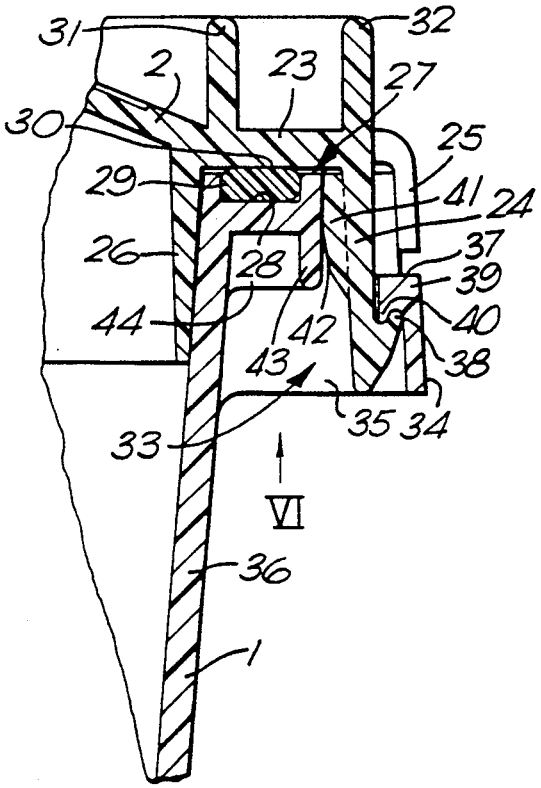
FIG. 5 is a fragmentary cross-sectional view on the line V—V in FIG. 1 of an inter-engagement zone of the lid and base of the steam generator.
Figure 6:
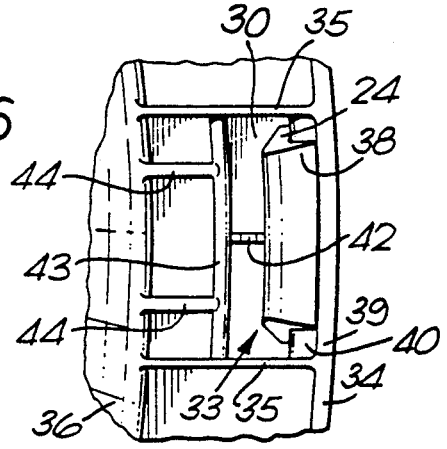
FIG. 6 is a fragmentary underneath view in the direction of arrow VI of the detail shown in FIG. 5.

Referring now to FIG. 5 in particular, the engagement of the lid 2 with the base 1 will be described. FIG. 5 shows the inter-engagement zone of the lid 1 and the base 2. In this zone the lid 2 has an annular region 23 outwardly of which it has at an even radius a series of eight equally circumferentially spaced, downwardly depending individual engagement members 24. Discrete and outwardly from these downwardly depend outer location flanges 25, circumferentially occupying the spaces between the individual engagement members 24. Inwardly of the annular region 23 a circumferentially continuous, inner location flange 26 extends. In the interengagement zone, the base 1 has an outwardly extending rim 27, having an annular recess 28 which provides a seat for a closed cell neoprene foam sealing ring 29, which on assembly, as shown in FIG. 5, is compressed between the plain undersurface 30 of the lid 2 at its annular region 23 and the recess 28. Above the surface 30, the lid has a first upstanding flange 31 for reinforcing it to exert compression on the sealing ring 29. A second reinforcement flange 32 extends around the lid 2 radially further out above its engagement members 24.

At the position of each lid-engagement member 24, an aperture 33 is provided in the rim 27 of the base 1, which rim otherwise extends out to a downwardly depending flange 34. Circumferentially positioned on each side of each aperture 33 is a radial web 35 extending between the sidewall 36 of the base 1 and the flange 34. The flange 34 has an outer step 37 for accommodating the outer location flanges 25 and providing a substantially flush exterior. The inner location flange 26 engages within the base sidewalls 36. Thus the lid is both centred on the base and stiffened in the inter-engagement zone.

The lid-engagement members 24 each have an upwardly turned lip 38 on their radially outer surface with an engagement face directed away from the base 1. The flange 34 at the apertures 33 is in effect a series of base-engagement members 39, each of which has a downwardly turned lip 40 with an engagement face directed away from the lid. On assembly of the lid 2 to the base, the lid-engagement members 24 flex inwardly and resiliently snap out when the lips 38,40 have passed and inter-engage at their engagement faces. This is the position shown in FIG. 5, in which the sealing ring 29 is compressed. To resist unintentional disengagement of the lips 38,40 and their engagement members 24,39, the lid-engagement members 24 are provided on the inside with ribs 41 which at their surface 42 abut the base 1 at the apertures 33. The inner edge of the apertures 33 are stiffened by flanges 43, each of which is supported by two integral struts 44 extending back to the sidewall 36.

It will be appreciated, from FIG. 5 that the particular arrangement of the lid-engagement members 24 being discrete and with the lips 38 on their outer sides, that the moulds for both the base 1 and the lid 2 have no overhanging parts necessitating expensive, complex moving parts of the moulds.

I claim:

1. A steam generator for generating steam at a pressure greater than ambient atmospheric pressure, comprising:

a moulded plastic base (1) including a sidewall (36);

a moulded plastic lid (2);

the lid (2) and the base (1) defining between them a circumferential inter-engagement zone;

the lid (2) having at the inter-engagement zone at least one engagement member (24) with an engagement face (38) directed generally away form the base (1), when assembled thereto;

the base (1) having at the inter-engagement zone at least one engagement member (39) with an engagement face (40) directed generally away from the lid (2), when assembled thereto;

an electrical heating element (4) mounted in the base (1); and an elastomeric sealing ring (29) arranged on assembly, around the circumferential inter-engagement zone, between the base (1) and the lid (2);

the lid-engagement and base engagement members (24, 39) engaging via their engagement faces (38, 40) with resilient deformation of either or both of the lid-engagement and base-engagement members (24, 39) on assembly of the lid (2) to the base (1) so as to compress the sealing ring (29) for sealing contact with both the base (1) and the lid (2), for containing steam in the generator at a pressure greater than an ambient atmospheric pressure; and means (P, W) for providing the steam from the generator at the pressure greater than the ambient atmospheric pressure.

2. A steam generator according to claim 1, wherein the engagement face(s) of at least one of the lid- and base-engagement members is a lip (38) adapted and arranged to engage the corresponding engagement face (40) of the other engagement member(s).

3. A steam generator according to claim 2, wherein the engagement faces of both of the lid- and base-engagement members are respective lips (38,40), each adapted and arranged to engage the corresponding lip on the corresponding other engagement member.

4. A steam generator according to claim 1, wherein one of the lid- and base-engagement members (24,39) extends generally towards the base or the lid (1,2) respectively and the other of the lid- and base-engagement members extends adjacent to the one of the said engagement members (when assembled thereto).

5. A steam generator according to claim 1, wherein one or other of the base and lid includes a recessed seat (28) for the elastomeric sealing ring (29) and the other of the base and the lid has a plain sealing surface (30) opposite the recessed seat.

6. A steam generator according to claim 5, wherein the recessed seat (28) and the plain sealing surface (30) are arranged inwardly of the lid- and base-engagement members (24,39).

7. A steam generator according to claim 5, wherein the recessed seat (28) is provided on the base.

8. A steam generator according to claim 1, wherein the lid- and the base-engagement members are circumferentially discontinuous around the lid and the base and are provided, circumferentially around the lid and the base, as a plurality of individual engagement members (24,39).

9. A steam generator according to claim 8, wherein the individual lid-engagement members (24) are provided inwardly of the corresponding individual base-engagement members (39).

10. A steam generator according to claim 9, wherein respective apertures (33) are provided between the sidewall (36) of the base and the individual base-engagement members (39) for receiving the corresponding lid-engagement members (24).

11. A steam generator according to claim 9, wherein radial webs (35) are provided to connect the individual base-engagement members (39) to the sidewall of the base.

12. A steam generator according to claim 9, wherein circumferential continuations (34) are provided to interconnect the individual base-engagement members (39).

13. A steam generator according to claim 1, wherein the lid includes an inner flange (26) for engaging inside the sidewall (36) of the base and inwardly of the recessed seat (28)-for the sealing ring (29).

14. A steam generator according to claim 1, wherein the lid includes a handle (9), a filling port (10), a steam outlet port (21) and a safety valve (31).

15. A steam generator comprising:

a moulded plastic base (1) including a sidewall (36);

a moulded plastic lid (2);

the lid and the base defining between them a circumferential inter-engagement zone;

the lid having at the inter-engagement zone at least one engagement member (24) with an engagement face (38) directed generally away from the base (1);

the base having at the inter-engagement zone at least one engagement member (39) with an engagement face (40) directed generally away from the lid (2);

an electrical heating element (4) mounted in the base (1); and an elastomeric sealing ring (29) arranged on assembly, around the circumferential inter-engagement zone, between the base (1) and the lid (2);

the lid- and base-engagement members (24, 39) engaging via their respective engagement faces (38, 40) with resilient deformation of both or either of the lid- and base-engagement members (24, 39) on assembly of the lid (2) to the base (1) so as to compress the sealing ring (29) for sealing contact with both the base (1) and the lid (2);

respective engagement faces (38, 40) of at least one of the lid- and base-engagement members (24, 39) being a lip (38) adapted and arranged to engage a corresponding engagement face (40) of the other engagement members;

one of the lid- and base-engagement members (24,39) extending generally towards the base or the lid (1,2) respectively and the other of the lid- and base-engagement members extending adjacent to the one of the said engagement members;

the lid- and the base-engagement members (24,39) being circumferentially discontinuous around the lid (2) and the base (1) and provided, circumferentially around the lid (2) and the base (1), as a plurality of individual engagement members (24,39); and apertures for said one of the lid- and base-engagement members (24,39) being provided at said other of the lid- and base-engagement members (24,39).

16. A steam generator comprising:

a moulded plastic base (1) including a sidewall (36);

a moulded plastic lid (2);

the lid (2) and the base (1) defining between them a circumferential inter-engagement zone;

the lid (2) having at the inter-engagement zone at least one engagement member (24) with an engagement face (38) directed generally away form the base (1), wherein each engagement member (24) is circumferentially discontinuous;

the base (1) having at the inter-engagement zone at least one engagement member (39) with an engagement face (40) directed generally away from the lid (2), wherein each engagement member (39) is circumferentially discontinuous around the base;

an electrical heating element (4) mounted in the base (1); and an elastomeric sealing ring (29) arranged on assembly, around the circumferential inter-engagement zone, between the base (1) and the lid (2);

wherein the lid-engagement and base-engagement members (24, 39) engage via their engagement faces (38, 40) with resilient deformation of either or both of the lid-engagement and base-engagement members (24, 39) on assembly of the lid (2) to the base (1) so as to compress the sealing ring (29) for sealing contact with both the base (1) and the lid (2), wherein each lid engagement member (24) is provided inwardly of the corresponding base-engagement member (39), when assembled thereto; and wherein respective apertures (33) are provided between the sidewall (36) of the base and the individual base-engagement members (39) for receiving the corresponding lid-engagement members (24), and wherein the radially inner edge of each aperture (33) is provided with a stiffening flange (43) and the corresponding lid-engagement member (24) is provided with an anti-disengagement surface (42) abutting the stiffening flange (43) when assembled thereto.

17. A steam generator according to claim 16, wherein one or more support struts (44) is provided to connect each stiffening flange (43) to the sidewall of the base.

18. A steam generator comprising:

a moulded plastic base (1) including a sidewall (36);

a moulded plastic lid (2);

the lid (2) and the base (1) defining between them a circumferential inter-engagement zone;

the lid (2) having at the inter-engagement zone at least one engagement member (24) with an engagement face (38) directed generally away form the base (1), wherein each engagement member (24) is circumferentially discontinuous;

the base (1) having at the inter-engagement zone at least one engagement member (39) with an engagement face (40) directed generally away from the lid (2), wherein each engagement member (39) is circumferentially discontinuous around the base;

an electrical heating element (4) mounted in the base (1); and an elastomeric sealing ring (29) arranged on assembly, around the circumferential inter-engagement zone, between the base (1) and the lid (2);

wherein the lid-engagement and base-engagement members (24, 39) engage via their engagement faces (38, 40) with resilient deformation of either or both of the lid-engagement and base-engagement members (24, 39) on assembly of the lid (2) to the base (1) so as to compress the sealing ring (29) for sealing contact with both the base (1) and the lid (2), wherein each lid engagement member (24) is provided inwardly of the corresponding base-engagement member (39), when assembled thereto; wherein circumferential continuations (34) are provided to interconnect the individual base-engagement members (39); and wherein the lid includes location flanges (25), provided separate from and radially outward from but in substantial circumferential continuation of the individual lid-engagement members (24), for location outside the circumferential continuations (34) of the individual base-engagement members.

19. A steam generator according to claim 18, wherein each of the said circumferential continuations (34) is stepped (37) to provide a lower portion having a radially outer surface flush with a radially outer surface of the corresponding said location flange (25).

20. A steam generator comprising:

a moulded plastic base (1) including a sidewall (36);

a moulded plastic lid (2);

the lid (2) and the base (1) defining between them a circumferential inter-engagement zone;

the lid (2) having at the inter-engagement zone at least one engagement member (24) with an engagement face (38) directed generally away form the base (1);

the base (1) having at the inter-engagement zone at least one engagement member (39) with an engagement face (40) directed generally away from the lid (2);

an electrical heating element (4) mounted in the base (1); and an elastomeric sealing ring (29) arranged on assembly, around the circumferential inter-engagement zone, between the base (1) and the lid (2);

wherein the lid-engagement and base-engagement members (24, 39) engage via their engagement faces (38, 40) with resilient deformation of at least one of the lid-engagement and base-engagement members (24, 39) on assembly of the lid (2) to the base (1) so as to compress the sealing ring (29) for sealing contact with both the base (1) and the lid (2); and wherein the lid includes at least one upstanding flange (31, 32) for reinforcement of the lid to exert compression on the sealing ring.

21. A steam generator according to claim 20, wherein the anti-disengagement surface (42) is provided on a rib (41) on the lid-engagement member (24).

22. A steam generator comprising:

a moulded plastic material base (1) including a sidewall (36);

a moulded plastic material lid (2);

the lid (2) and the base (1) defining between them a circumferential inter-engagement zone;

the lid (2) having at the inter-engagement zone at least one engagement member (24) with an engagement face (38) directed generally away from the base (2);

the base (2) having at the inter-engagement zone at least one engagement member (39) with an engagement face (40) directed generally away from the lid (1);

an electrical heating element (4) mounted in the base (2);

an elastomeric sealing ring (29) arranged on assembly, around the circumferential inter-engagement zone, between the base (2) and the lid (1);

the lid- and base-engagement members (24, 39) engaging via their engagement faces (38, 40) with resilient deformation of either or both of the lid- and base-engagement members (24, 39) on assembly of the lid (1) to the base (2) so as to compress the sealing ring (29) for sealing contact with both the base (2) and the lid (1);

the engagement face (38, 40) of at least one of the lid- and base-engagement members (24, 39) being a lip (38) adapted and arranged to engage the corresponding engagement face (40) of the other engagement member(s);

one of the lid- and base-engagement members (24, 39) extending generally towards the base (2) or the lid (1) respectively and the other of the lid- and base-engagement members (24,39) extending adjacent to the one of the engagement members (24, 39);

the lid- and the base-engagement members (24, 39) being circumferentially discontinuous around the lid (1) and the base (2) and provided, circumferentiall around the lid (1) and the base (2), as a plurality of individual engagement members (24, 39); and apertures for the one of the lid- and base-engagement members (24, 39) being provided at the other of the lid- and base engagement members (24, 39).

23. A steam generator for generating steam at a pressure greater than ambient atmospheric pressure, comprising:

a moulded plastic base (1) including a sidewall (36);

a moulded plastic lid (2);

the lid (2) and the base (1) defining between them a circumferential inter-engagement zone;

the lid (2) having at the inter-engagement zone at least one engagement member (24) with an engagement face (38) directed generally away form the base (1), when assembled thereto;

the base (1) having at the inter-engagement zone at least one engagement member (39) with an engagement face (40) directed generally away from the lid (2), when assembled thereto;

an electrical heating element (4) mounted in the base (1);

an elastomeric sealing ring (29) arranged on assembly, around the circumferential inter-engagement zone, between the base (1) and the lid (2);

the lid-engagement and base-engagement members (24, 39) engaging via their engagement faces (38, 40) with resilient deformation of either or both of the lid-engagement and base-engagement members (24, 39) on assembly of the lid (2) to the base (1) so as to compress the sealing ring (29) for sealing contact with both the base (1) and the lid (2), for containing steam in the generator at a pressure greater than an ambient atmospheric pressure;

a steam conduit (P); and connection means (21) for connection to the steam conduit (P) for providing the steam from the generator at the pressure greater than the ambient atmospheric pressure.

* * * * *

UNITED STATES PATENT AND TRADEMARK OFFICE

CERTIFICATE OF CORRECTION

PATENT NO. : 5,305,415

DATED : April 19, 1994

INVENTOR(S) : Paul Stevens

It is certified that error appears in the above-identified patent and that said Letters Patent is hereby corrected as shown below:

At column 4, line 48, please replace "form" with --from--.

At column 6, line 41, please replace "form" with --from--.

At column 7, line 16, please replace "form" with --from--.

At column 7, line 61, please replace "form" with --from--.

At column 9, line 6, please replace "form" with --from--.

Signed and Sealed this

Eighteenth Day of October, 1994

*Attest:*

*Attesting Officer*

Bruce Lehman

BRUCE LEHMAN

*Commissioner of Patents and Trademarks*